US005772200A

United States Patent [19]

Sorensen

[11] Patent Number: 5,772,200

[45] Date of Patent: Jun. 30, 1998

[54] FEEDER FOR SHEET FORM ELEMENTS

[76] Inventor: Alan M. Sorensen, 59 Langley Ave., Worcester Park, Surrey, KT4 8PB, England

[21] Appl. No.: 637,395

[22] Filed: Apr. 25, 1996

[30] Foreign Application Priority Data

Apr. 26, 1995 [GB] United Kingdom ..... 9508478

[51] Int. Cl.[6] ..... B65H 5/08

[52] U.S. Cl. ..... 271/11; 271/98; 271/101; 271/103; 271/107; 271/166

[58] Field of Search ..... 271/11, 14, 98, 271/99–101, 103, 106, 107, 166, 10.14, 10.16

[56] References Cited

U.S. PATENT DOCUMENTS

| | | | |
|---|---|---|---|
| 2,520,628 | 8/1950 | Elsner | 271/11 |
| 2,850,279 | 9/1958 | Stoothoff et al. | 271/103 |
| 3,503,606 | 3/1970 | Castellanet | 271/166 |
| 3,861,667 | 1/1975 | Jahme . | |
| 4,093,207 | 6/1978 | Greenwell et al. | 271/166 X |
| 4,436,299 | 3/1984 | Orsinger . | |
| 4,463,942 | 8/1984 | Newsome | 271/98 X |
| 4,690,395 | 9/1987 | Nowicki | 271/98 |
| 4,759,679 | 7/1988 | Muller . | |
| 4,901,996 | 2/1990 | Schlough | 271/100 X |
| 4,976,420 | 12/1990 | Flensburg et al. | 271/100 X |
| 5,133,540 | 7/1992 | Suzuki et al. . | |
| 5,398,920 | 3/1995 | Leu . | |

FOREIGN PATENT DOCUMENTS

| | | | |
|---|---|---|---|
| 543681 | 1/1932 | Germany | 271/107 |
| 4037377 | 5/1992 | Germany | 271/106 |
| 1152909 | 4/1985 | U.S.S.R. | 271/11 |
| 271849 | 9/1927 | United Kingdom . | |
| 901816 | 7/1962 | United Kingdom . | |
| 1 304 924 | 1/1973 | United Kingdom . | |
| 2 060 579 | 5/1981 | United Kingdom . | |
| 2 275 917 | 9/1994 | United Kingdom . | |

*Primary Examiner*—Boris Milef
*Attorney, Agent, or Firm*—Larson & Taylor

[57] ABSTRACT

A feeder for separating sheet form elements, such as envelopes, from a stack has a suction device and a mechanical gripper mounted together on a movable head. The movement of the head is controlled by a lever mechanism and cams so that an envelope is first pulled by the suction in the stacking direction and then gripped and pulled laterally from the stack by the gripper.

15 Claims, 6 Drawing Sheets

FIG. 5
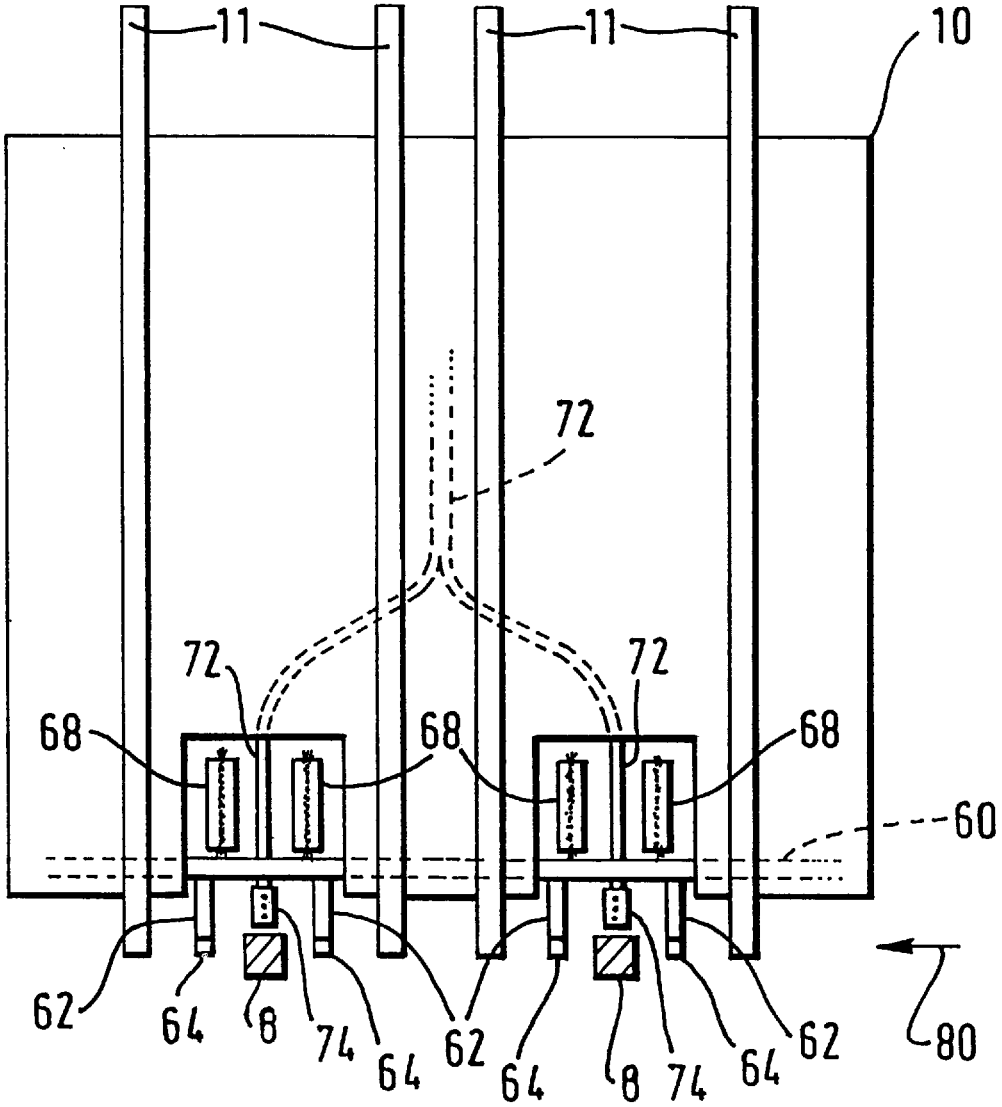
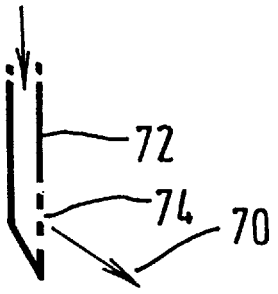
FIG. 6

FEEDER FOR SHEET FORM ELEMENTS

FIELD OF THE INVENTION

The present invention relates to feeders for sheet form elements, especially but not exclusively used to feed envelopes to a printing machine. The invention also relates to a printing machine having such a feeder, and to a method of feeding sheet form elements using such a feeder.

In the present specification the phrase "sheet form element" is used to refer for example to sheets of paper, envelopes or the like. It may also refer to films and sheets of plastics or metal, either rigid or flexible.

DESCRIPTION OF THE PRIOR ART

In the prior art, several types of envelope feeder are known. In one, individual envelopes are separated from a stack of envelopes by friction using a wheel, scraper or rubber belt. In another prior art feeder, suction devices are used to separate individual envelopes from a stack of them. In both cases the envelopes that have been separated are received by rollers to forward the envelopes to a printing press. These feeders suffer from the disadvantages that the envelopes tend to jam in the feeder and rollers and, if latex or other self-seal pre-glued envelopes are used, adhesive from the envelopes tends to accumulate on the feeder and rollers, causing malfunction and requiring frequent cleaning.

In the prior art, general feeders are also used for envelopes, and remove individual envelopes from the top of a hopper by suction and then feed them into rollers or onto a conveyor belt to a printing press (see for example U.S. Pat. No. 3,980,292). These feeders do not operate continuously as they must be stopped frequently in order to refill the hopper. This is a problem with envelopes as they are bulky and do not readily stack in large numbers.

Prior art proposals for sheet feeders having both suction devices and grippers are shown in GB-A-2 060 579, GB-A-2 275 917 and U.S. Pat. No. 3,861,667. U.S. Pat. No. 5,398, 920 shows a device for forming a stack of folded sheets, having a suction device and grippers. U.S. Pat. No. 4,436, 299 shows a suction device for pulling sheets downwardly from the bottom of a stack, having a rod linkage for tilting the suction head. U.S. Pat. No. 4,759,679 describes a loading device for x-ray films, having a suction head which picks up an edge of the top film of a stack and rotates it through 90°. Then a gripper clamps the film against the suction head, and the suction head and gripper are moved upwardly perpendicularly to the sheets in the stack. U.S. Pat. No. 5,133,540 shows in one embodiment a device for opening bags having a suction head and a gripper mounted on an arm. The suction head is pivotally mounted on the arm. This device does not itself remove bags from the stack.

SUMMARY OF THE INVENTION

The present invention aims to provide a feeder for sheet form elements which can operate continuously and reliably without Jamming, and a method of continuously feeding sheet form elements using the feeder.

According to the present invention there is provided a feeder for separating sheet form elements from a stack of such sheet form elements, comprising in combination a suction device for pulling the sheet form element away from the stack in the stacking direction and a gripper for gripping the sheet form element and pulling it laterally from the stack, said suction device and gripper being both mounted on the same movable head, the feeder further having a drive for said movable head arranged for moving the head in a path including both movement in the stacking direction and movement laterally from the stack.

By the "stacking direction" here is meant the direction perpendicular to the plane of a sheet in the stack. The lateral direction is the direction parallel to this plane. The drive for the movable head provides a movement having at least a component in the stacking direction so that the suction device draws the sheet form element at least partly away from the stack and at least a component in the lateral direction so that the head draws the sheet form element laterally from the stack.

In a second aspect, there is provided a method of extracting a sheet form element from a stack of such elements using a feeder having suction device and a gripper both mounted on a movable head, comprising the steps of engaging the suction device with the lowermost sheet form element of the stack, moving said movable head so that the engaged sheet form element is pulled away from the stack at least partly in the stacking direction by the suction device gripping the engaged sheet form element mechanically with said gripper, and moving the head so as to move said engaged sheet form element gripped by the gripper laterally from the stack.

Preferably the suction device is provided with an aperture or apertures to engage the sheet form element from one side and preferably the gripper clamps the sheet form element from a second side, against the suction aperture or apertures. The gripper may have a gripping arm which, as seen looking onto the suction aperture, covers the aperture in its clamped position or lies over a region or regions of the movable head adjacent the suction aperture.

In order to provide a compact and simple construction, and to simplify control, preferably the gripper has a gripping arm pivotable about an axis on the movable head, said suction device and axis being in a fixed spatial relationship on the movable head during operation of the feeder. In the case where the suction aperture is provided by a collapsible cup, it is here meant that the fixed base of the cup is fixed in position relative to the pivot axis of the gripper arm.

Preferably, the feeder is provided with a plurality of the movable heads, each movable head having a suction device and gripper, the movable heads operating synchronously.

The suction device may optionally be provided with a cut-off valve to control the suction applied to the head.

In the preferred embodiment, the gripping means comprise a gripping arm fixed to an operating wheel which is pivotally mounted on the movable head, and the gripping arm has, remote from the operating wheel a gripping arm head so that in a first condition the gripping arm head locates at the aperture or apertures of the suction device and in a second condition the gripping arm head, is kept clear from the movable head. The gripping arm is biased into the second condition by a spring and pulled into the first condition by a cable.

The invention also provides a combination of a feeder of the invention as described above, and a stack holder such as a hopper for the sheet form elements, e.g. envelopes, preferably with the feeder arranged to extract the sheet form elements through an aperture in the bottom of the stack holder.

The present invention is particularly well adapted for feeding envelopes as the gripper and suction device can be positioned to avoid adhesive on the envelope, and so adhesive does not accumulate on the feeder.

Optionally, an air blower may be provided to help separate the sheet form elements in the stack and, when envelopes are the sheet form element, to keep the envelope flaps closed while individual envelopes are separated.

Optionally, the sheet form elements may be controlled when held in the stack by a fixed or moving brush or brushes. The axis of this brush or brushes may be perpendicular or parallel to the stacking direction.

The present invention is also well suited for feeding sheet form elements to a printing machine, the printing machine may for example be capable of printing different labels on envelopes. By a printing machine here I mean also laser printers and other printing devices as well as conventional printing machines.

BRIEF INTRODUCTION OF THE DRAWINGS

The invention will now be described by way of non-limitative example by reference to the embodiments shown in the accompanying drawings in which:

FIG. 5 shows a view of the second embodiment of the feeder of the present invention, in the direction V of FIG. 4;

FIG. 6 is a side view of an air blower of FIG. 5, in more detail;

Figure 2:
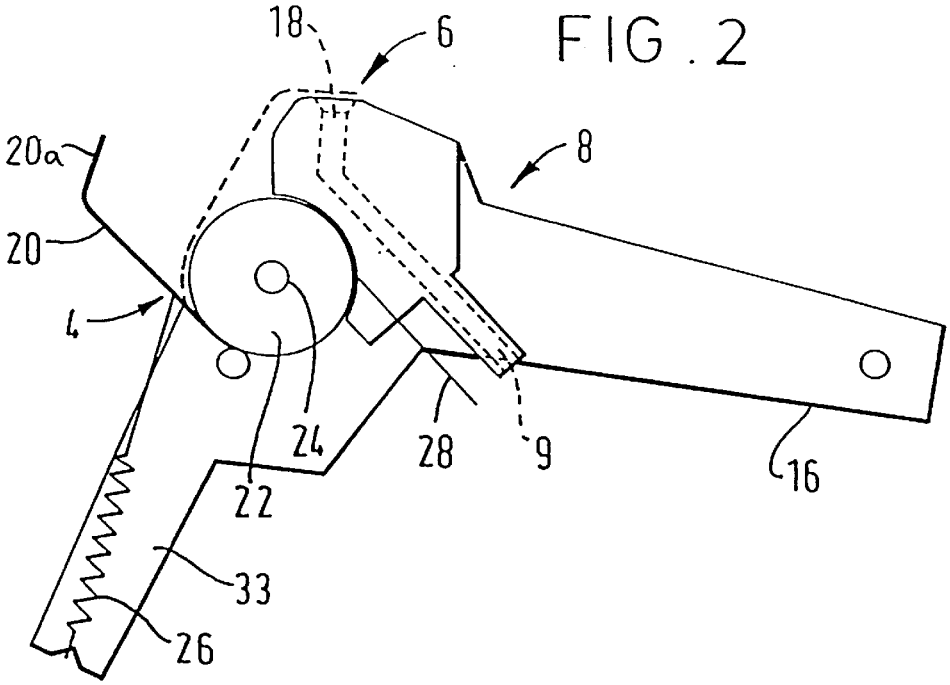
FIG. 2 is an enlarged side view of the movable head of one form of the sheet feeder of FIG. 1.
Figure 7A:
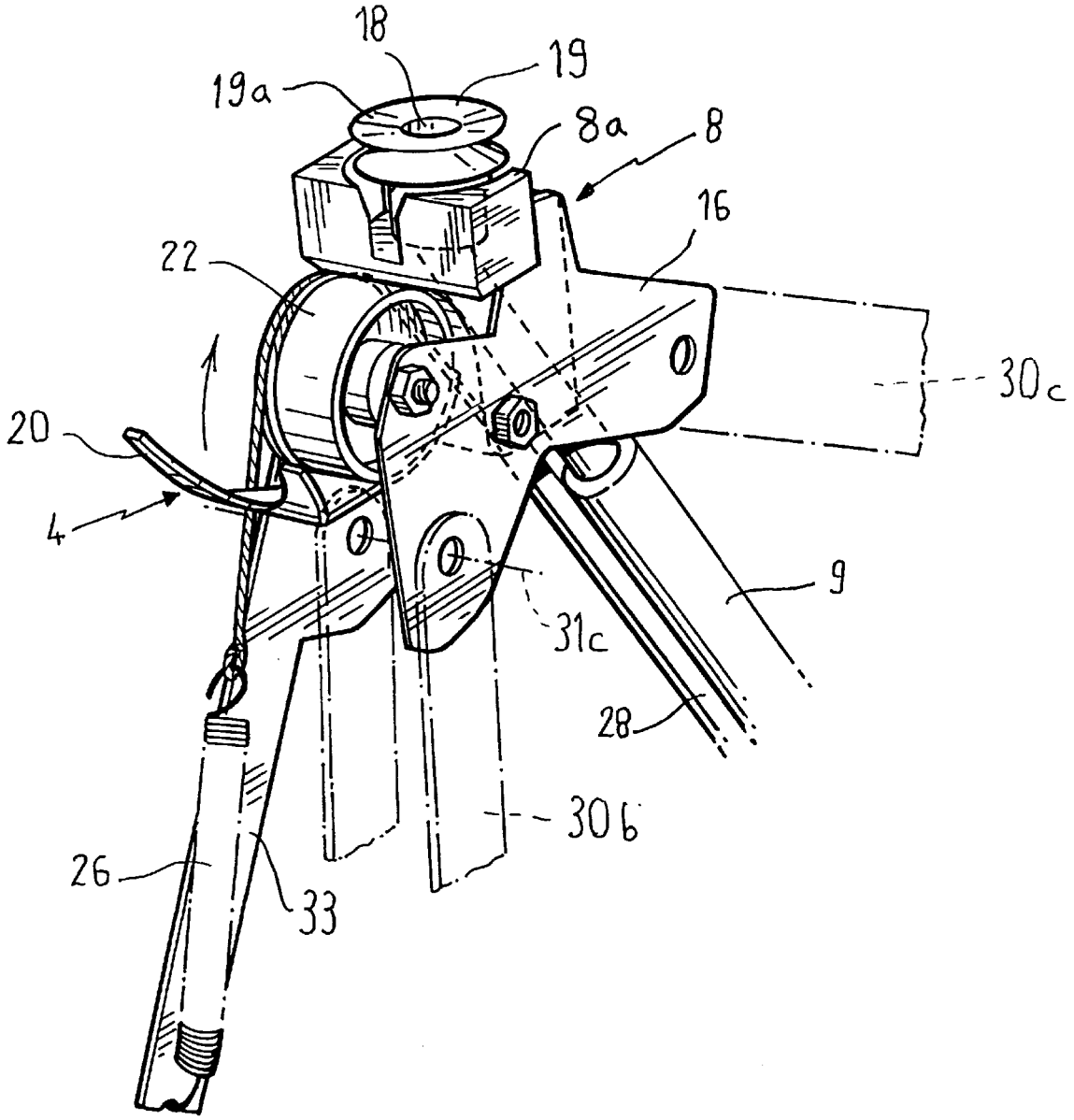
Figure 7B:
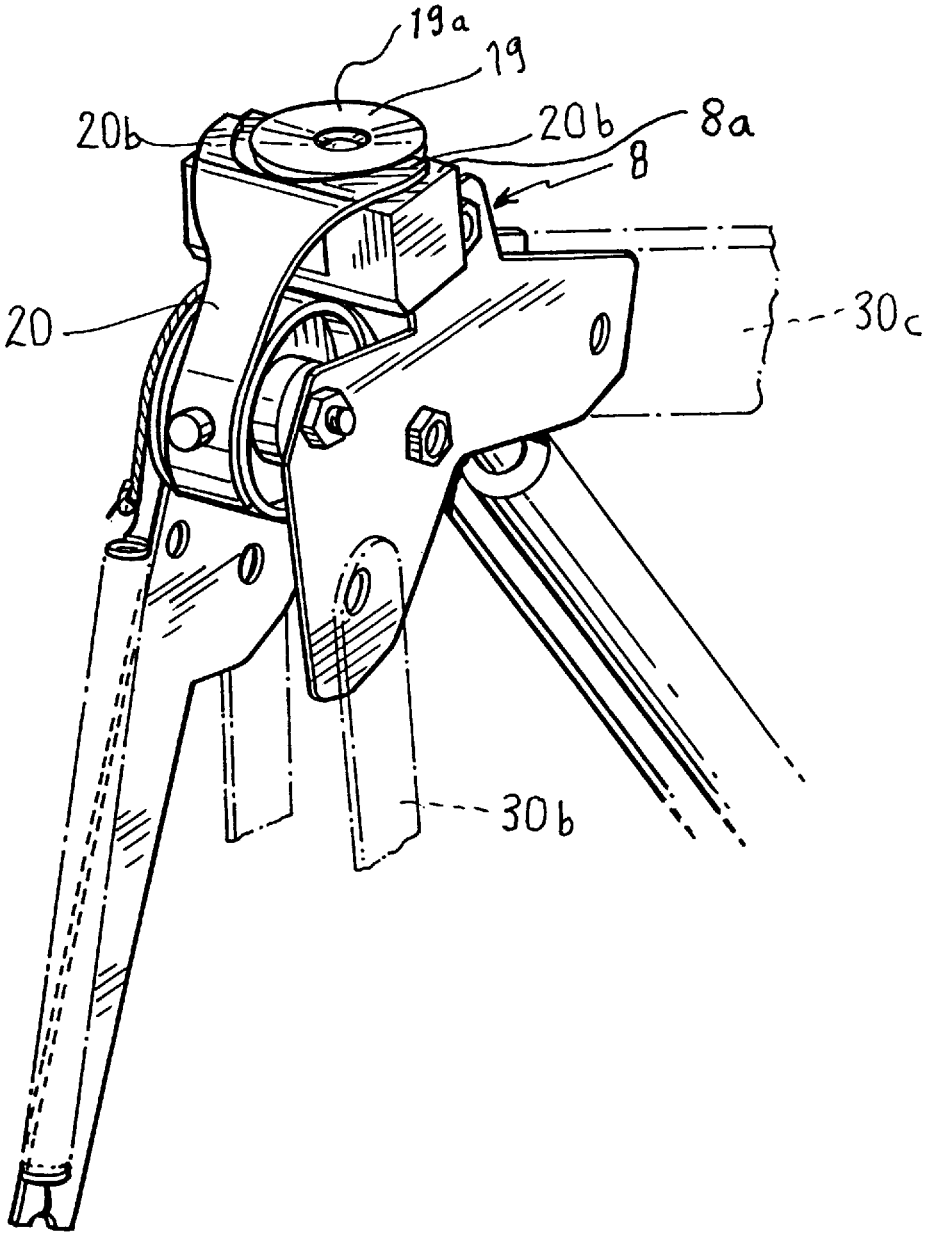

FIGS. 7*a* and 7*b* are perspective views of the movable head of a second form which is a slight modification of that of FIG. 2.

DESCRIPTION OF THE PREFERRED EMBODIMENTS

Figure 1:
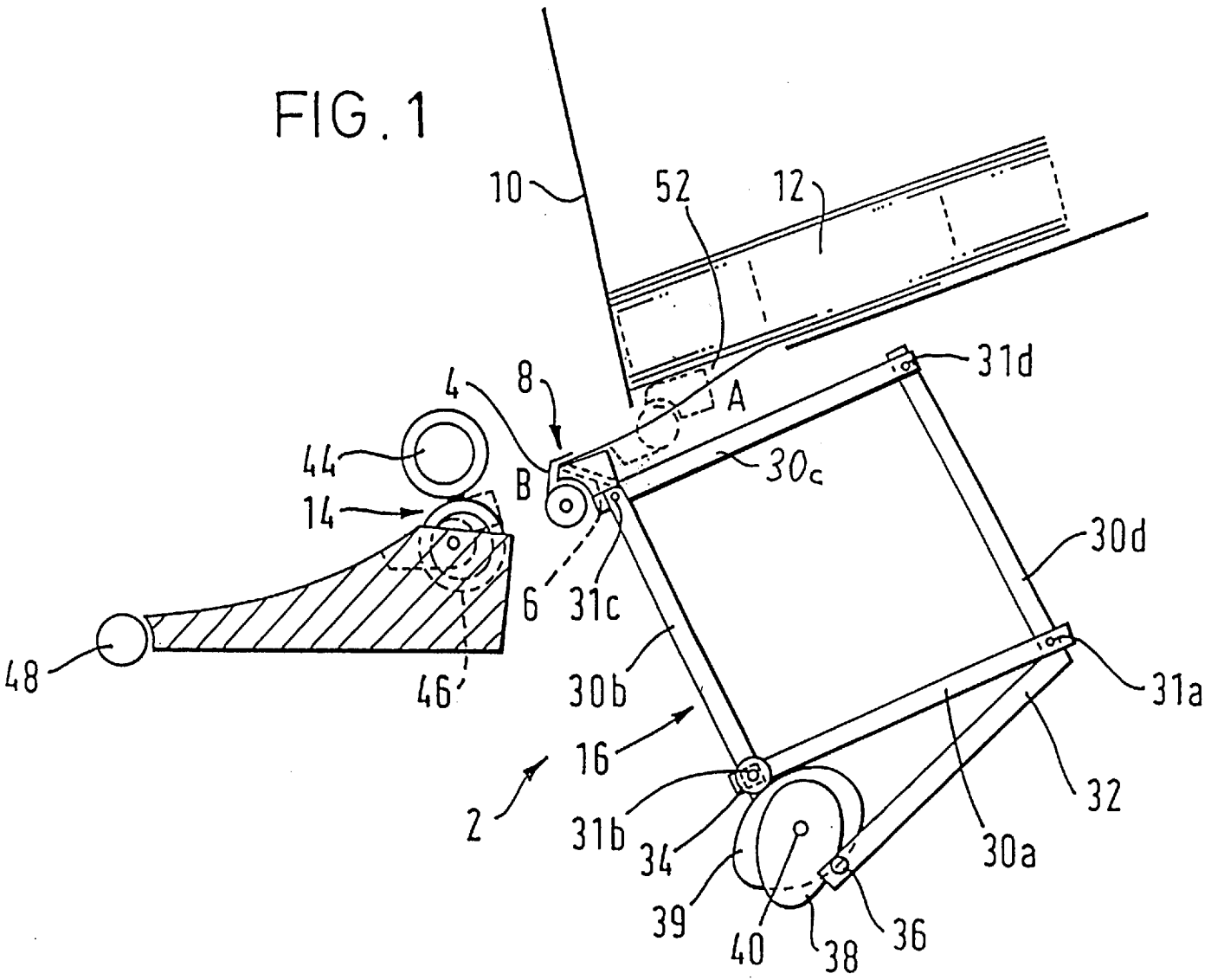
FIG. 1 is a view, partly sectioned, from one side of a first embodiment of the feeder of the present invention.

FIG. 1 shows a feeder 2 embodying the invention having gripping means 4 and suction means 6 both located on a movable head 8. The feeder 2 is located adjacent to a hopper 10 containing a stack of envelopes 12 and also adjacent to receiving means 14 for removing envelopes from the feeder 2. The movable head 8 is mounted on a four lever mechanism 16 which is in turn driven by a cam system. As described below, a plurality of these heads 8 (in this case four in number) are mounted in common on the four lever mechanism 16.

FIG. 2 is an enlarged side view of the head 8 showing the suction means 6 and gripping means 4. The suction means 6 are positioned on the top face 16 of the movable head 8 and comprise an aperture 18 located on the top face of the head 8, connected via a passage 9 through the head and tubing (not shown) to a suction pump (not shown). Optionally the suction means 6 can be provided with a valve to control the suction applied to the head 8.

The gripping means 4 are located on the movable head 8 adjacent the suction means and comprise a bent gripping arm 20 with gripping head 20*a* mounted on an operating wheel 22, said gripping head 20*a* being remote from the operating wheel. The operating wheel 22 is rotatably attached to the movable head 8 at an axis 24. The gripping arm 20 is biased into its open condition by a spring 26 connecting it to an extension 33 of the head 8. A cable 28, e.g. a Bowden cable, is connected to the operating wheel 22. When pulled, the cable 28 rotates the operating wheel 22 and moves the gripping arm 20 into a second position (seen in broken lines in FIG. 2) in which the gripping head 20*a* is located at the aperture 18 of the suction means 6.

The four lever mechanism 16 has four levers 30*a*, 30*b*, 30*c*, 30*d* connected pivotally to each other to form a quadrilateral linkage at four pivot points 31*a*, 31*b*, 31*c*, 31*d*. The lever 30*d* has an extension 32. The lever 30*c* carries the movable head 8 in a fixed position on it.

A cam system 38, 39 is provided to drive and direct the movement of the four lever mechanism 16, and thus determine the path of the head 8, and acts on the pivot 31*b* and the extension 32 of the lever 30*d*. The extension 32 and the pivot 31*b* are each provided with a cam follower 34, 36, in contact with the surfaces of the two cams 38, 39. The two cams are driven via a common cam shaft 40 by a motor (not shown). The cam shaft 40 also drives a mechanism (not shown) to control the cable 28.

The receiving means 14 comprise a roller 44 in contact with forwarding wheels 46. The roller 44 is mounted above the forwarding wheels 46 on an axis parallel to the axis of the forwarding wheels 46. In FIG. 1 the roller 44 is driven clockwise and the forwarding wheels 46 anti-clockwise so as to pass an envelope presented to them to a conveyor 48, for onward transport to, for example, a printing machine.

Figure 3:
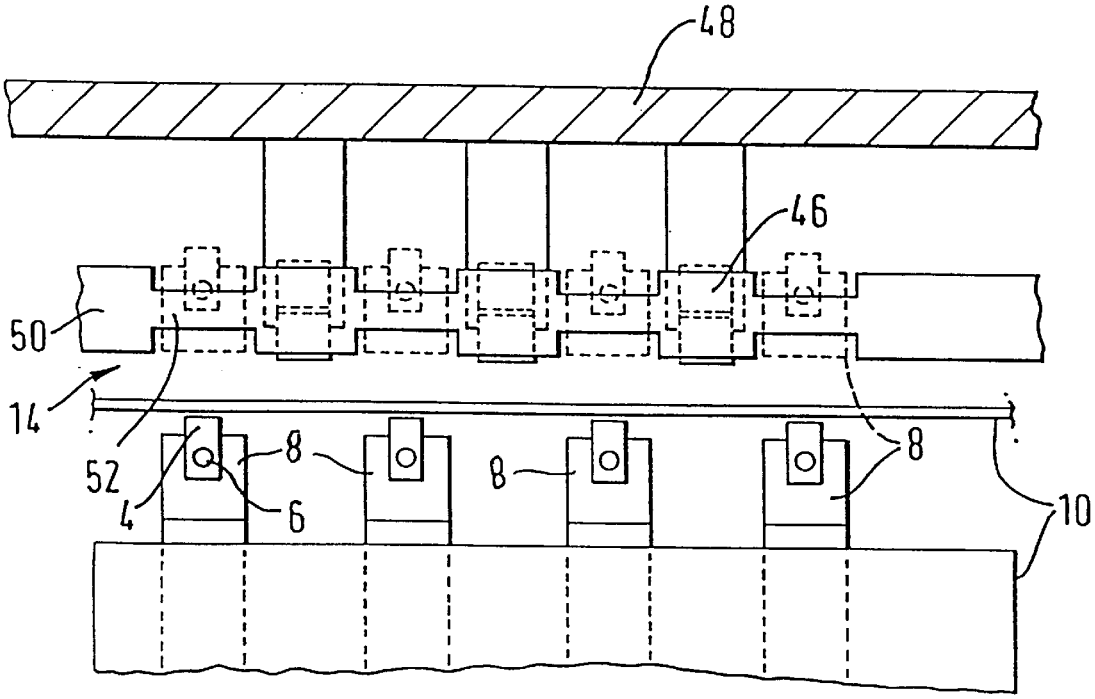
FIG. 3 is a plan view of the feeder and the movable head, of FIG. 1.

The detailed structure of the roller 44 is shown in FIG. 3. The roller 44 has larger diameter portions 50 and smaller diameter portions 52. The larger diameter portions 50 are in contact with the forwarding wheels 46 and serve to grip a sheet presented to them by the head 8. The smaller diameter portions 52 allow the head 8 mounted on the four lever mechanism 18 to approach the receiving means 14, so that the head 8 fits under the smaller diameter portions 52 and between adjacent larger diameter portions 50, to present an envelope between the larger diameter portions 50 and the forwarding wheels 46.

FIGS. 7*a* and 7*b* show a modified form of the movable head 8. Since this modified form differs only slightly from the head of FIGS. 1 and 2, only the differences will be described. Like parts have the same reference numerals.

As in FIGS. 1 and 2, the projecting arm 16 of the head 8 is rigidly fixed to the lever 30*c* of the quadrilateral linkage, and the head forms in effect an extension of the lever 30*c* being connected pivotally to the lever 30*b* at pivot 31*c*. A vacuum pipe 9 extends through the head 8 and terminates at the fixed base of a collapsible rubber suction cup 19. The cup 19 normally (see FIG. 7*a*) projects a small distance above the adjacent top surface of the head 8. When an envelope contacts the cup 19, the vacuum in the cup causes its collapse (see FIG. 7*b*), bringing the envelope down onto the top surface of the head.

The gripping arm 20 in this form does not cover the aperture 18, but has a bifurcated head having two fingers 20*b* which, in the gripping position of FIG. 7*b*, overlie the top surface 8*a* of the head on opposite sides of the cup 19.

In the head of FIGS. 1 and 2 the pivot 24 of the gripping arm 20 and the aperture 18 of the suction means are always at fixed relative locations. Likewise in FIGS. 7*a* and 7*b*, the pivot of the arm 20 and the fixed base of the collapsible cup 19 are in fixed relative locations.

The operating cycle of the feeder 2 will now be described. The cam system 38,39 drives the four lever mechanism 16 so that the movable head 8 passes into an aperture in the base of the hopper 10 containing a stack of envelopes. As the movable head 8 approaches the bottom envelope 12 in the stack, the gripping arm 20 is kept clear of the suction means 6 in its open condition and the suction means 6 are operating (see position A in FIG. 1). The portion of the bottom envelope 12 directly above or in contact with the head 8 is drawn towards the apertures 18 located on the top face of the head 8 and is held in contact with the head 8 by suction.

The cam system then drives the four lever mechanism 16 so that the head 8 is moved downwards, pulling a portion of the envelope 12 away from the stack in the stacking direction and creating a gap 52 between it and the next envelope above. As the gap 52 is created, the gripping arm 20 is pulled into its second condition by the cable 28 to mechanically clamp the envelope 12 against the upper contact surface 19*a* of cup 19 containing the suction aperture 18.

When the envelope 12 has thus been trapped, the cam system 38,39 drives the four lever mechanism 18 to bring the head 8 down and laterally away from the hopper 10, pulling the envelope 12 clear of the stack. The cam system then drives the head 8 and envelope 12 towards the receiving means 14 (see B in FIG. 1 and FIG. 3). The movable head 8 is adapted to fit between adjacent forwarding wheels 46 and the large diameter portions 50 of the roller 44. After the envelope is in the receiving means 14, and while the head 8 is still moving at the same speed as the surfaces of the wheels 46 and roller 44, the cable 28 is released, allowing the spring 26 to restore the gripping arm 20 to the open position. The movable head 8 then moves away from the envelope 12.

If the suction means 6 are provided with a cut-off valve, the valve interrupts the suction force when the gripping arm 20 ceases to clamp the envelope. On the other hand, where no cut-off valve, is provided, the suction force applied to the suction means 6 is sufficiently low to permit the roller 44 and forwarding wheels 46 to pull the sheet form element 12 off the movable head 8 without damaging it. Once released, the sheet form element 12 is moved through the receiving means 14 to be carried, for example, to the printing machine (not shown). The cam system 38,39 then drives the four lever mechanism 18 bearing the head 8 to its original position below the hopper 10.

The feeder 2 is in this embodiment provided with multiple movable heads 8 which are moved synchronously as shown in FIG. 3, to improve the grip exerted on the envelope 12 or allow multiple side-by-side stacks of envelopes to be fed into the printing press simultaneously.

The combination of suction to free the envelope partly from the stack and mechanical gripping to draw it from the bottom of the stack achieves reliable and accurate feeding at a uniform rate. The gripping provides sufficient lateral drawing force to overcome frictional forces, avoiding slippage which may occur if suction alone is used. The suction easily separates the envelopes one-by-one from the stack without damage. The combination of suction and gripping can avoid the use of excessive force alone which may damage the envelope.

If particularly heavy sheet form elements or large capacity hoppers are used, the downward force of the stack of sheet form elements in the hopper or the weight of the element itself may make it difficult for the feeder to remove sheet form elements from the stack without damage. In this case the hopper may be provided with a blower to direct air laterally at the stack to help separate the sheets in the stack and make it easier for the feeder to remove successive bottom sheet form elements.

Although shown herein as extracting envelopes from the bottom of a stack, the feeder of the invention can in principle operate in any orientation, and can be used for removing sheet form elements from the top of a stack.

Figure 4:
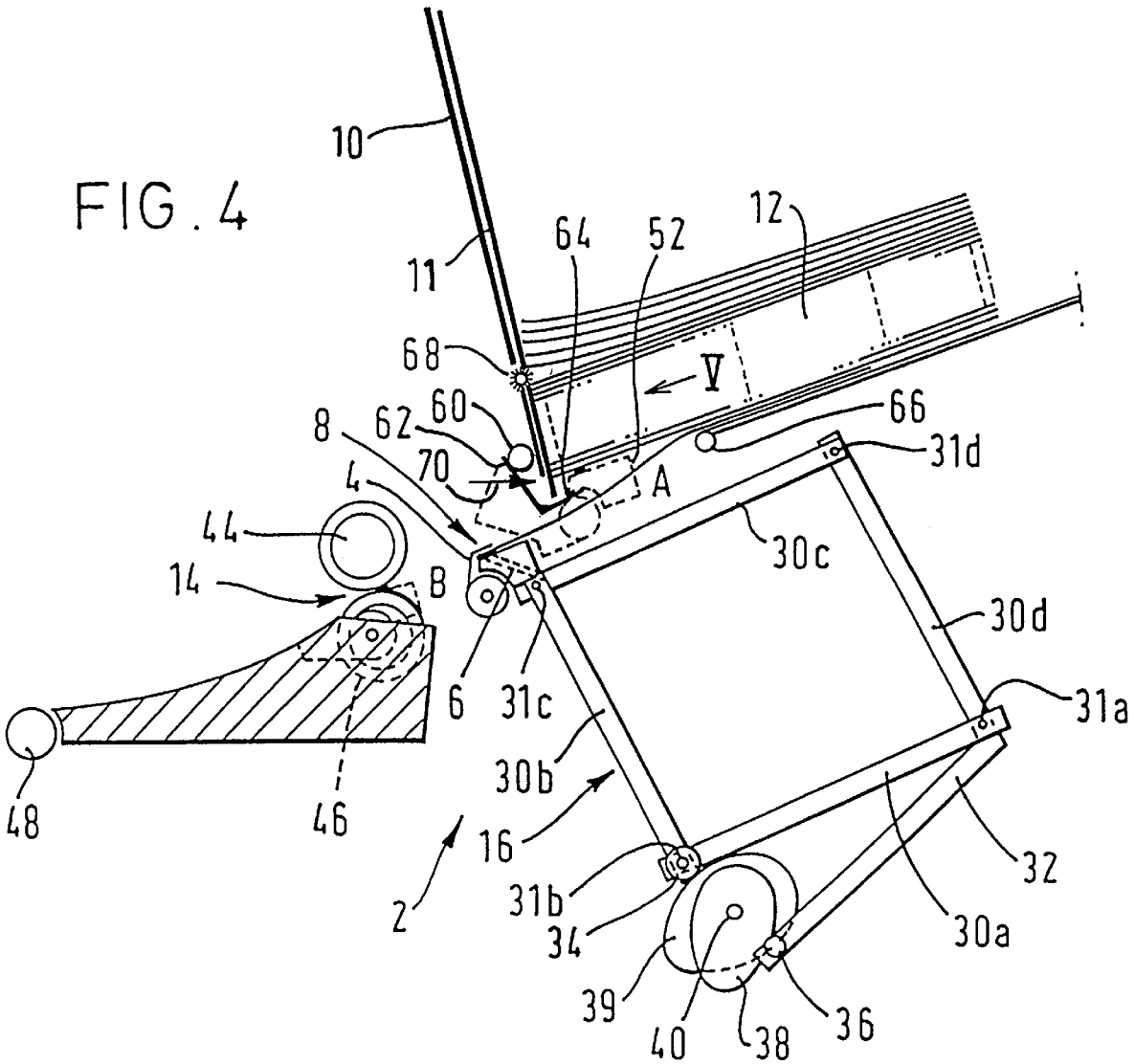
FIG. 4 shows a view of a second embodiment of the feeder of the present invention similar to the first embodiment of the feeder, with additional optional features.

FIGS. 4 to 6 show a second embodiment, being an improved version of the first embodiment. Since the improvements are achieved by the addition of certain distinct features, only these additional features will be described.

Firstly, a retaining catch is provided, comprising a member 60 pivotally mounted on the outside of the hopper 10 and having four downwardly extending arms 62. Each arm has an inwardly projecting finger 64 remote from the member 60. The catch has two positions, one of which is the rest position, shown in full lines in FIG. 5. When the catch is in this position, the fingers 64 project beneath the hopper outlet. As the movable head 8 approaches the stack, a cam arrangement (not shown) causes the retaining catch 60 to pivot away from beneath the hopper to the second position, shown dotted in FIG. 4. In this position the fingers 64 no longer project beneath the hopper outlet. This allows removal of the lowest envelope 12 by the suction and gripping head 8. After the head 8 has completed its initial downward movement, the retaining catch 60 is then pivoted back to its rest position by the cam arrangement, thus preventing further envelopes from being dragged along with the lowest envelope when the latter is pulled laterally out of the hopper by the movable head 8.

A freely rotating forwarding roller 66 is also provided in this embodiment, at the rear edge of the hopper outlet. This assists removal of the lowest envelope 12 by reducing friction. The forwarding roller 66 may alternatively be driven by e.g. an electric motor during removal of the envelope 12.

A brush roller 68 is provided, whose fibres project into the hopper. The brush roller is driven by a motor (not shown). Envelopes are retained between fibres of the brush roller 68 and thus rotation of the brush roller 68 allows a controlled lowering of envelopes in the hopper. A height sensor (not shown), for example a microswitch, is provided in the base of the hopper. This sensor controls rotation of the brush roller 68 in dependence on the sensed weight of envelopes in the hopper. It is preferable to provide a cam arrangement to withdraw the sensor during removal of an envelope, although this is not necessary.

In effect, the stack is divided by the brush roller 68 into a lower stack from which envelopes are removed, and an upper stack from which envelopes are fed to the lower stack. The height sensor senses only the height of the lower stack.

Compressed air is blown in the direction of arrow 70 (FIG. 4) from four sets of nozzles 74 supplied by pipes 72. This air penetrates between envelopes in the stack 12, separating them and also probably increasing the suction effect of the suction head 8. The separating effect is enhanced by blowing the air in a direction angled downwards at 45° to the plane of the envelopes, as shown.

In this second embodiment, the ends of the envelopes rest against vertical strips 11 within the hopper 10. These strips 11 extend below the vertical extent of the end wall 10 of the hopper and permit better access to the stack 12 via the spaces between them.

Arrow 80 in FIG. 5 shows the level of the lowest envelope in the stack.

Although particular embodiments have been described and illustrated, the invention is not limited to them, and extends to all constructions incorporating the inventive concept herein described.

What is claimed is:

1. A feeder for separating sheet form elements from a stack of such sheet form elements, comprising in combination: a movable head, a suction device for pulling one of the sheet form elements away from the stack in the stacking direction and a gripper for gripping the one sheet form element and pulling it laterally from the stack, said suction device and gripper being both mounted on the movable head, the feeder further having a drive for said movable head arranged for moving the head in a path including both movement in the stacking direction and movement laterally from the stack, said suction device having a contact surface surrounding a suction aperture which in use engages said sheet form elements, and said gripper having a gripping arm movable between a gripping position in which in use said gripping arm clamps a sheet form element against said contact surface, and a release position, said gripping arm having a pair of spaced apart gripping portions which in said gripping position lie on opposite sides of said contact surface.

2. A feeder according to claim 1 in which the gripping arm is pivotable about an axis on the movable head, said suction device and axis being in a fixed spatial relationship on the movable head during operation of the feeder.

3. A feeder according to claim 1, wherein said suction device, comprises a collapsible cup having a base attached to the movable head.

4. A feeder according to claim 1 wherein said drive for the moveable head comprises a plurality of cam-actuated levers.

5. A feeder according to claim 4 wherein four said levers are pivotally connected to each other as a quadrilateral linkage.

6. A feeder according to claim 1 having means for directing gas flow toward a face of the stack such that the flow direction is not perpendicular to the plane of sheet form elements within the stack.

7. A feeder according to claim 1 having a rotating member provided with radially extending flexible members, the rotating member being arranged such that the flexible members interdigitate with sheet form elements within the stack, thereby to divide the stack into a lower stack portion and an upper stack portion supported at least partly by the flexible members;

wherein rotation of the rotating member allows transfer of a number of sheet form elements from the upper stack portion to the lower stack portion.

8. A feeder according to claim 7 having a sensor for sensing the amount of sheet form elements in the lower stack portion and driving means for driving the rotating member;

wherein the driving means operates when the sensor senses that the lower stack portion contains less than a predetermined amount of sheet form elements.

9. A feeder according to claim 1 in combination with a stack holder for holding the stack of the sheet form elements, arranged to draw the sheet form element from the bottom of the stack.

10. A printing machine having a stack holder for a stack of sheet form elements and a feeder according to claim 1.

11. A feeder according to claim 1 wherein said feeder comprises a plurality of said movable heads which are synchronously driven by said drive.

12. A feeder according to claim 11 wherein said plurality of said heads are arranged to allow simultaneous feeding of multiple sheet form elements from multiple side-by-side stacks of sheet form elements.

13. A method of extracting sheet form elements from a stack of such elements using a feeder having a suction device and a fork-ended gripper both mounted on a movable head, comprising the steps of engaging the suction device with the lowermost sheet form element of the stack, moving said movable head so that the engaged sheet form element is pulled away from the stack at least partly in the stacking direction by the suction device, gripping the engaged sheet form element mechanically against and at opposite sides of said suction device with said forked end of the gripper such that said forked end of the gripper does not overlie the suction device, and moving the head so as to move the engaged sheet form element gripped by the gripper laterally from the stack.

14. A feeder for separating sheet form elements from a stack of such sheet form elements, comprising in combination: a movable head a suction device for pulling one of the sheet form elements away from the stack in the stacking direction and a gripper for gripping the one sheet form element and pulling it laterally from the stack, said suction device and gripper being both mounted on the movable head, the feeder further having a drive for said movable head arranged for moving the head in a path including both movement in the stacking direction and movement laterally from the stack, said drive for the movable head comprising a plurality of cam-actuated levers, four of said cam-actuated levers being pivotally connected to each other to form a quadrilateral linkage.

15. A feeder for separating sheet form elements away from a stack of such sheet form elements comprising, a suction device for pulling one of the sheet form elements away from the stack in the stacking direction; a gripper for gripping the one sheet form element and pulling it laterally from the stack; a movable head, said suction device and said gripper being both mounted on the movable head, said gripper comprising a gripping arm pivotable about an axis on the movable head, said suction device and axis being in a fixed spatial relationship on the movable head during operation of the feeder, and said gripper further comprising a rotatable member connected to said gripping arm and rotatable about said axis, said rotatable member having a track which is circumferential with respect to said axis; a drive arranged to move said movable head in a path including both movement in the stacking direction and movement laterally from the stack; and an actuating means, said actuating means comprising a Bowden cable, said Bowden cable having a portion lying on said track such that pulling of said Bowden cable causes rotation of said rotatable member.

* * * * *